US009221157B1

(12) United States Patent
Chen

(10) Patent No.: US 9,221,157 B1
(45) Date of Patent: Dec. 29, 2015

(54) ANGLE CONTROLLING DEVICE FOR A WRENCH

(71) Applicant: YUNG FONG TOOLS CO., LTD., Taichung (TW)

(72) Inventor: Tzu-Chun Chen, Taichung (TW)

(73) Assignee: YUNG FONG TOOLS CO., LTD., East Dist., Taichung (TW)

( * ) Notice: Subject to any disclaimer, the term of this patent is extended or adjusted under 35 U.S.C. 154(b) by 0 days.

(21) Appl. No.: 14/445,077

(22) Filed: Jul. 29, 2014

(51) Int. Cl.
*B25B 23/16* (2006.01)
*B25B 23/00* (2006.01)
*B25B 13/48* (2006.01)

(52) U.S. Cl.
CPC ..... *B25B 23/0028* (2013.01); *B25B 13/481* (2013.01); *B25B 23/16* (2013.01)

(58) Field of Classification Search
CPC B25B 23/0028; B25B 13/481; B25B 13/461; B25B 23/16; B25G 1/063
USPC ..... 81/177.7, 177.8, 177.75, 177.85
See application file for complete search history.

(56) References Cited

U.S. PATENT DOCUMENTS 4,901,608 A * 2/1990 Shieh ..... B25G 1/063 81/177.8
6,131,490 A * 10/2000 Lee ..... B25B 13/461 81/177.2
7,472,631 B1 * 1/2009 Wu ..... B25B 13/461 81/177.8
7,509,893 B2 * 3/2009 Wu ..... B25B 13/08 81/177.8
8,245,604 B2 * 8/2012 Chen ..... B25B 23/0028 81/177.8
8,276,485 B1 * 10/2012 Chen ..... B25B 23/008 81/135
8,413,553 B2 * 4/2013 Chen ..... B25B 13/461 81/177.8
2004/0144219 A1 * 7/2004 Lin ..... B25G 1/063 81/177.8
2005/0268753 A1 * 12/2005 Lin ..... B25B 13/461 81/177.9
2006/0042425 A1 * 3/2006 Lin ..... B25G 1/063 81/177.9
2006/0174733 A1 * 8/2006 Hsieh ..... B25G 1/063 81/177.8
2013/0269491 A1 * 10/2013 Chang ..... B25B 23/16 81/177.8
2014/0202290 A1 * 7/2014 Hsieh ..... B25G 1/063 81/177.8

* cited by examiner

*Primary Examiner* — Hadi Shaker
*Assistant Examiner* — Danny Hong

(57) ABSTRACT

An angle adjusting device for a wrench contains: an operating handle, a connecting head, an accommodating cavity, and a driving member. The driving member has a toothed portion arranged in the accommodating cavity. The accommodating cavity has two orifices defined on two extending arms thereof, and the toothed portion has an aperture for corresponding to the two orifices, such that a coupling post is inserted into the two orifices and the aperture. The accommodating cavity also has a notch, and the connecting head has a trough accommodating a first resilient element and a pressing member. The notch accommodates a second resilient element and a retainer, the retainer has a cutout and an indentation defined on one side of the cutout. The pressing member has a small-diameter column extending outwardly from a central position thereof and a circular retaining tab arranged on a rear end of the small-diameter column.

6 Claims, 10 Drawing Sheets

ANGLE CONTROLLING DEVICE FOR A WRENCH

FIELD OF THE INVENTION

The present invention relates to an angle controlling device for a wrench which controls a retainer to engage with or disengage from a toothed portion of a driving member by ways of a pressing member and the retainer.

BACKGROUND OF THE INVENTION

A conventional angle controlling structure of a wrench contains a steel ball or a retainer for retaining with a toothed portion of a driving member of the wrench. The conventional angle controlling structure also contains a pushing structure so that when a push post presses inwardly, the steel ball or the retainer falls into a recess on the push post and removes from the toothed portion of the driving head, thus adjusting an operational angle.

However, since the steel ball or the retainer completely removes from the toothed portion, the operational angle cannot be adjusted precisely.

The present invention has arisen to mitigate and/or obviate the afore-described disadvantages.

SUMMARY OF THE INVENTION

The primary object of the present invention is to provide an angle controlling device for a wrench which controls a retainer to engage with or disengage from a toothed portion of a driving member by ways of a pressing member and the retainer.

Another object of the present invention is to provide an angle controlling device for a wrench in which a notch accommodates a second resilient element and the retainer, such that when the pressing member release the retainer, the second resilient element pushes the retainer to abuts against the toothed portion of the driving member so that when the driving member rotates, the retainer rotatably contacts with the toothed portion.

To obtain the above objectives, an angle controlling device for a wrench which provided by the present invention contains: an operating handle, a connecting head connecting with a front end of the operating handle, an accommodating cavity defined in a front end of the connecting head, and a driving member coupling with a front end of the connecting head.

The driving member has a toothed portion formed on a rear end thereof and arranged in the accommodating cavity of the connecting head.

The accommodating cavity has two orifices defined on two extending arms of two sides thereof, and the toothed portion of the driving member has an aperture formed therein to correspond to the two orifices, such that a coupling post is inserted into the two orifices and the aperture to connect the connecting head the driving member together.

The accommodating cavity also has a notch arranged in a rear end thereof, and the connecting head has a trough defined on one of the two sides thereof and accommodating a first resilient element and a pressing member.

The notch accommodates a second resilient element and a retainer, the retainer has a cutout extending backwardly from a middle section thereof and has an indentation defined on one side of the cutout.

The pressing member has a small-diameter column extending outwardly from a central position thereof and a circular retaining tab arranged on a rear end of the small-diameter column.

DETAILED DESCRIPTION OF THE PREFERRED EMBODIMENTS

Figure 1:
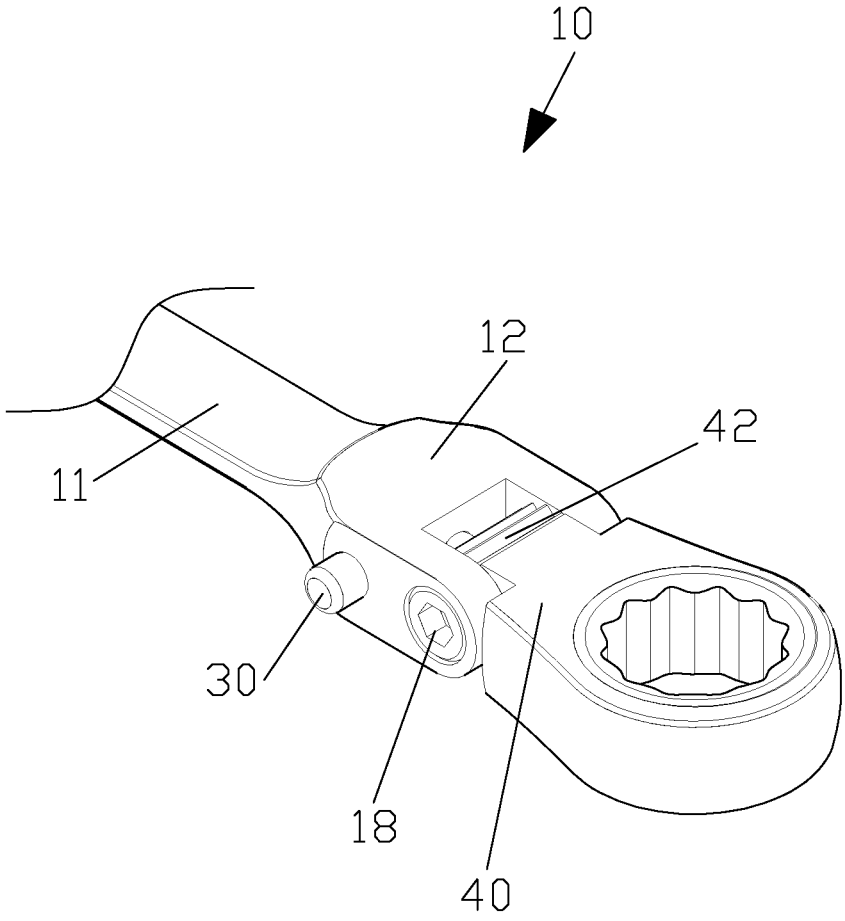
FIG. 1 is a perspective view showing the assembly of an angle controlling device for a wrench according to a first embodiment of the present invention.
Figure 2:
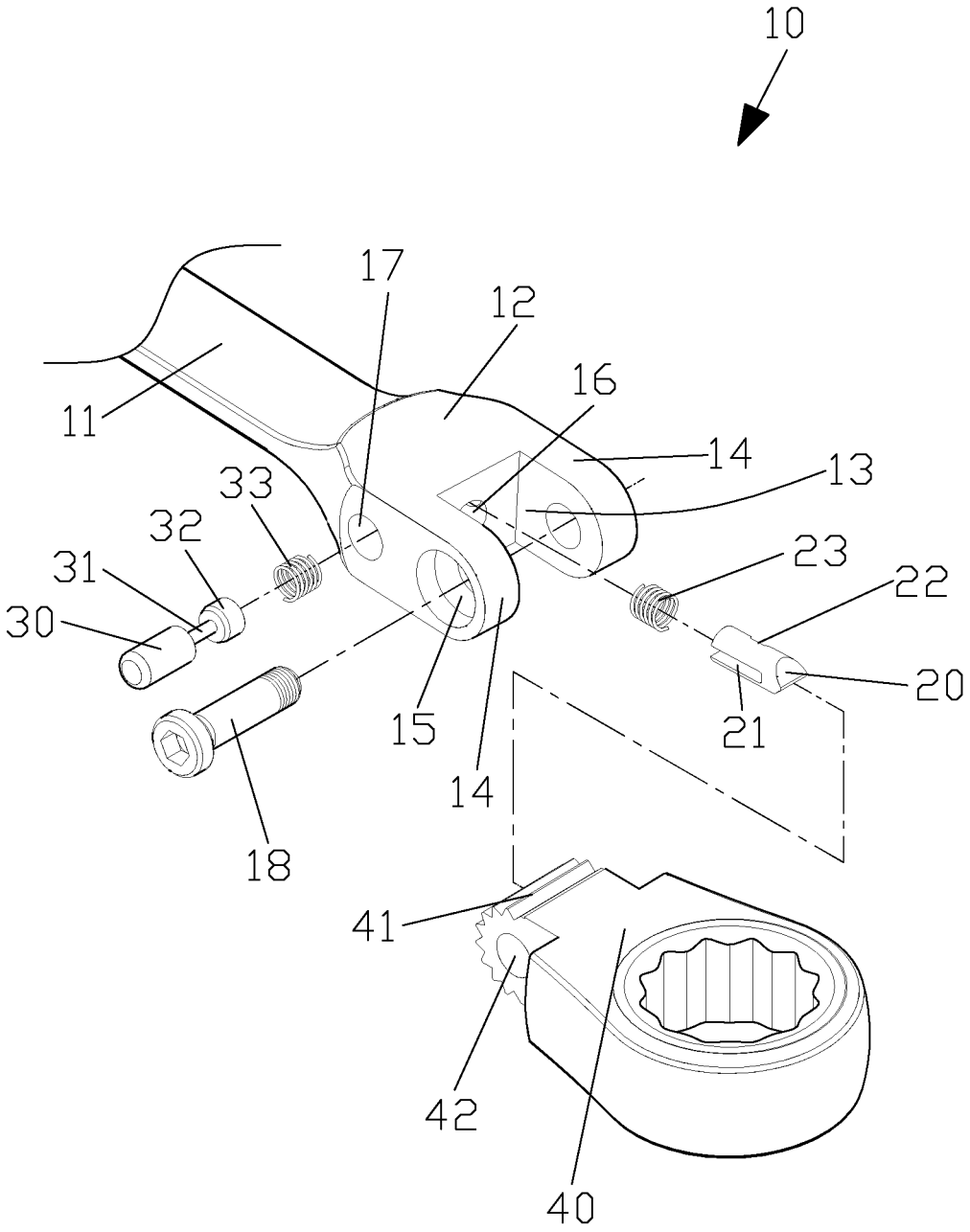
FIG. 2 is a perspective view showing the exploded components of the angle controlling device for the wrench according to the first embodiment of the present invention.
Figure 3:
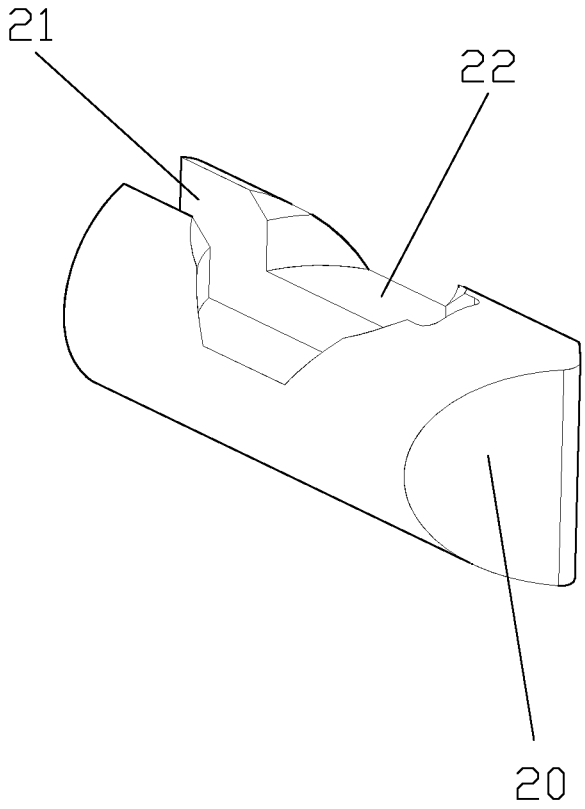
FIG. 3 is a perspective view showing the assembly of a retainer of the angle controlling device for the wrench according to the first embodiment of the present invention.
Figure 4:
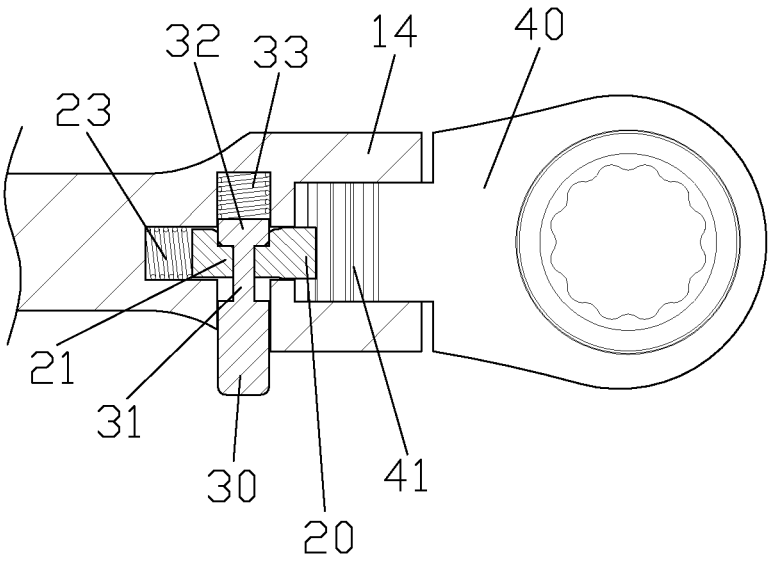
FIG. 4 is a cross sectional view showing the operation of the retainer of the angle controlling device for the wrench according to the first embodiment of the present invention.
Figure 5:
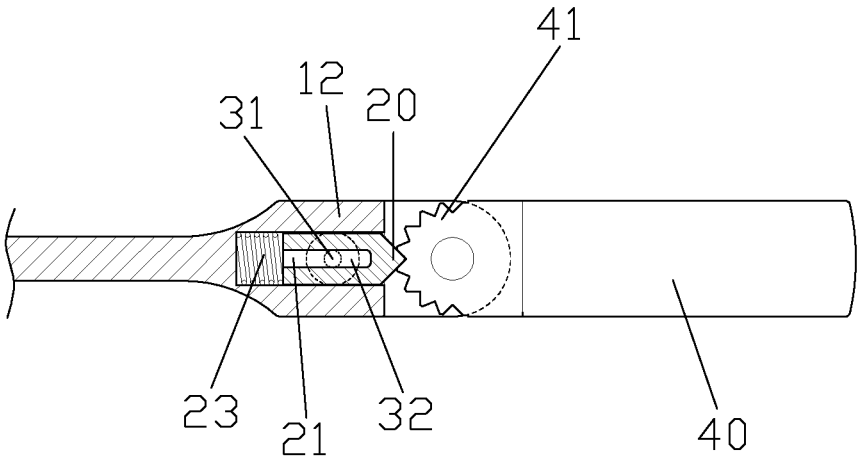
FIG. 5 is another cross sectional view showing the operation of the retainer of the angle controlling device for the wrench according to the first embodiment of the present invention.
Figure 6:
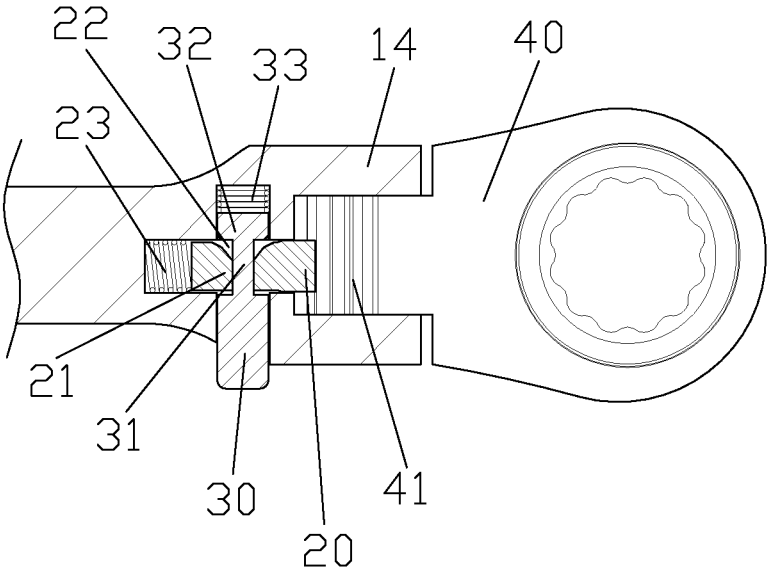
FIG. 6 a cross sectional view showing the operation of the retainer of the angle controlling device for the wrench according to the first embodiment of the present invention.
Figure 7:
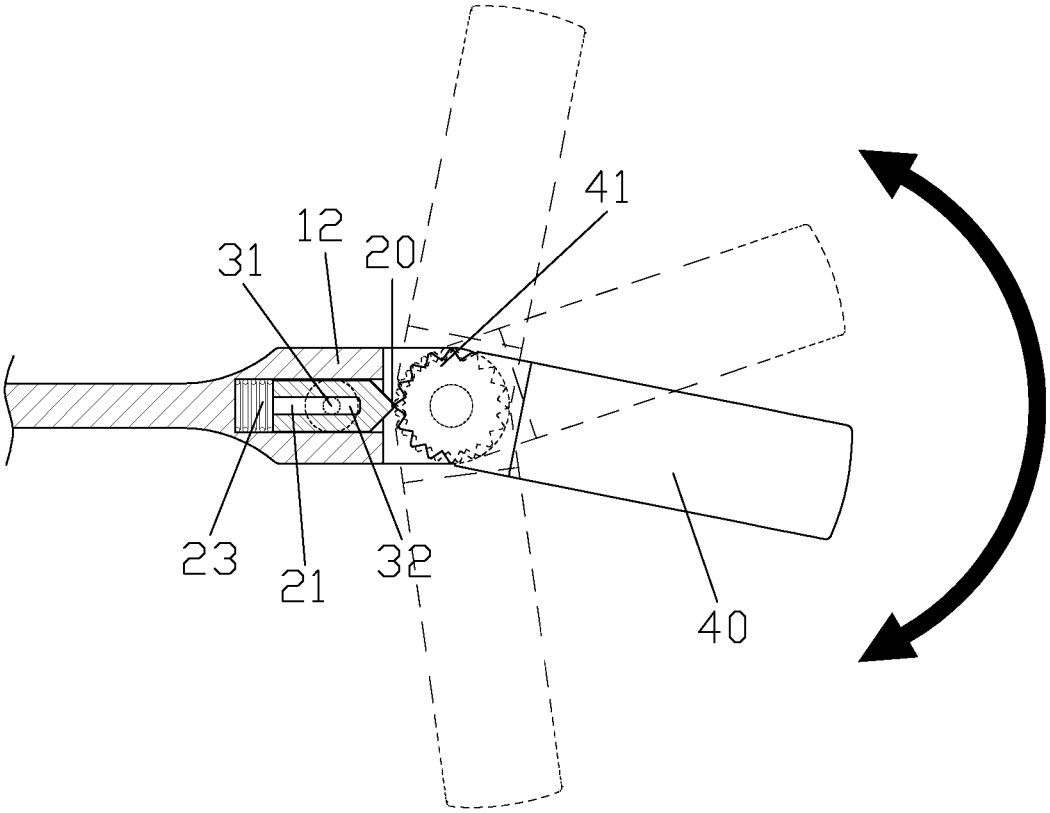
FIG. 7 is another cross sectional view showing the operation of the retainer of the angle controlling device for the wrench according to the first embodiment of the present invention.

With reference to FIGS. 1 to 3, an angle adjusting device for a wrench 10 according to a first embodiment of the present invention comprises: an operating handle 11, a connecting head 12 connecting with a front end of the operating handle 11, an accommodating cavity 13 defined in a front end of the connecting head 12, a driving member 40 coupling with a front end of the connecting head 12. The driving member 40 has a toothed portion 41 formed on a rear end thereof and arranged in the accommodating cavity 13 of the connecting head 12.

The accommodating cavity 13 has two orifices 15 defined on two extending arms 14 of two sides thereof, and the toothed portion 41 of the driving member 40 has an aperture 42 formed therein to correspond to the two orifices 15, such that a coupling post 18 is inserted into the two orifices 15 and the aperture 42 to connect the connecting head 12 the driving member 14 together. The accommodating cavity 13 has a notch 16 arranged in a rear end thereof, and the connecting head 12 has a trough 17 defined on one of the two sides thereof and vertically communicating with the notch 16 and accommodating a first resilient element 33 and a pressing member 30. The pressing member 30 has a small-diameter column 31 extending outwardly from a central position thereof and a circular retaining tab 32 arranged on a rear end of the small-diameter column 31, and the notch 16 accommodates a second resilient element 23 and a retainer 20. The retainer 20 has a cutout 21 extending backwardly from a middle section thereof and has an indentation 22 defined on one side of the cutout 21.

Referring to FIGS. 4 to 7, when the pressing member 30 is in connection with the retainer 20, the small-diameter column 31 of the pressing member 30 moves in the cutout 21 of the retainer 20, and the circular retaining tab 32 of the pressing member 30 retains in the indentation 22 of the retainer 20, such that when the pressing member 30 does not move, the circular retaining tab 32 is engaged in the indentation 22, and the toothed portion 41 of the driving member 40 engages with the retainer 20. When the pressing member 30 is pushed inwardly, the circular retaining tab 32 disengages from the indentation 22. Because the second resilient element 23 pushes the retainer 20, the retainer 20 abuts against the toothed portion 41 of the driving member 40, and when the driving member 40 rotates, the retainer 20 rotatably contacts with the toothed portion 41.

Figure 8:
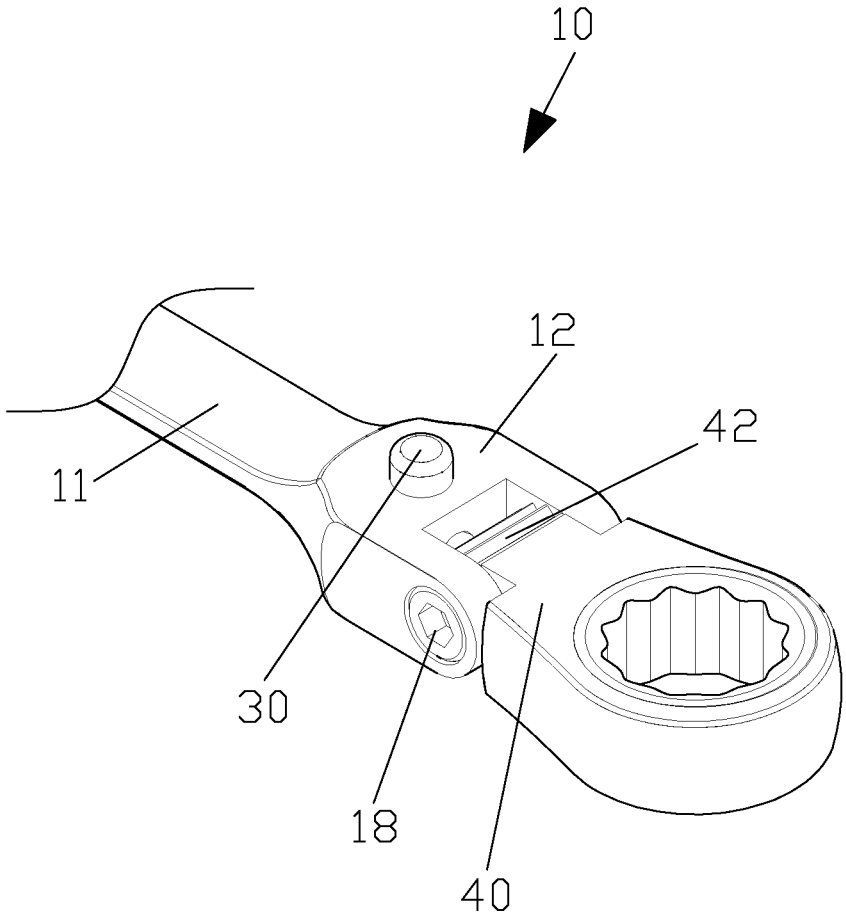
FIG. 8 is a perspective view showing the assembly of an angle controlling device for a wrench according to a second embodiment of the present invention.
Figure 9:
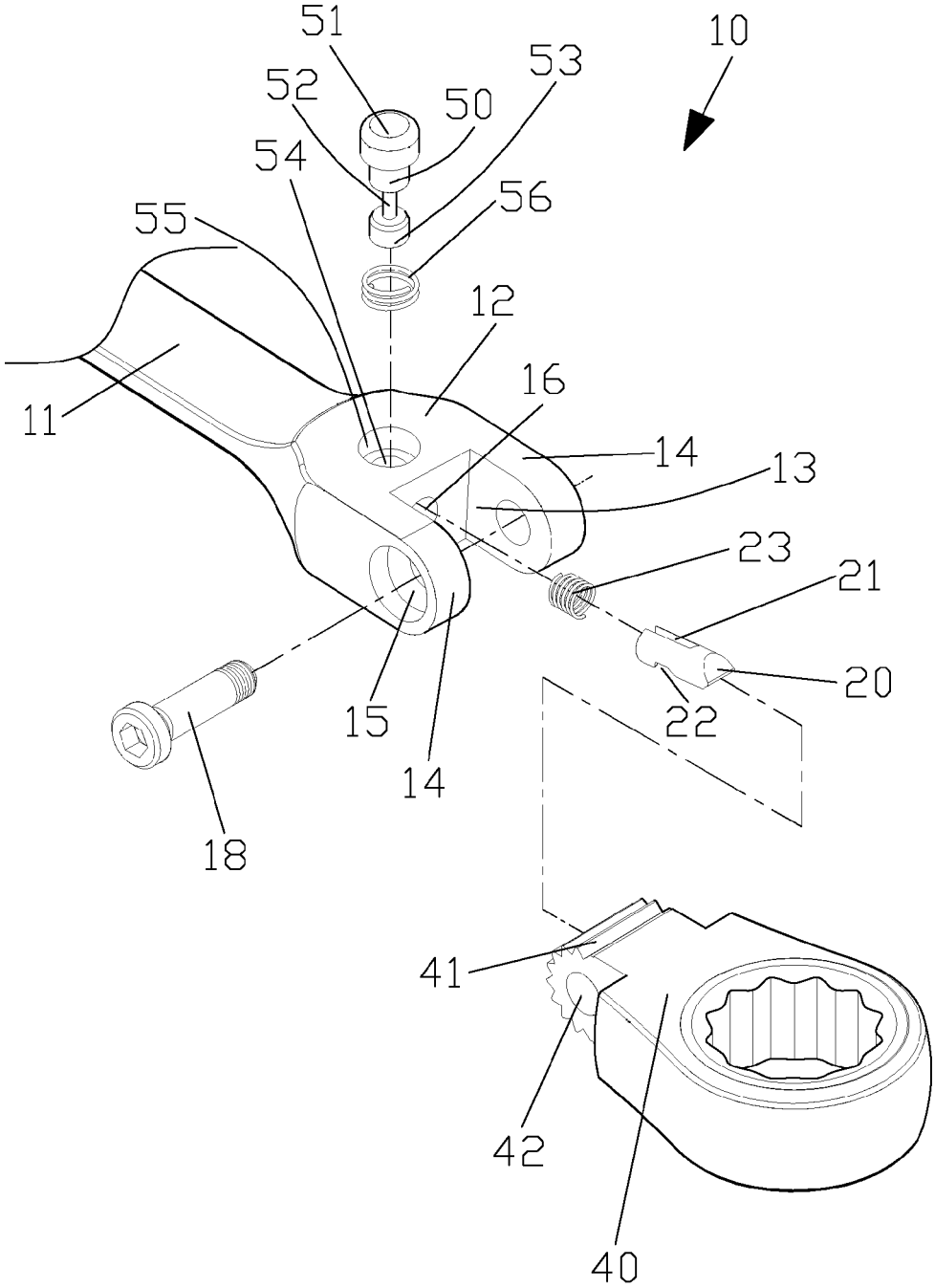
FIG. 9 is a perspective view showing the exploded components of the angle controlling device for the wrench according to the second embodiment of the present invention.
Figure 10:
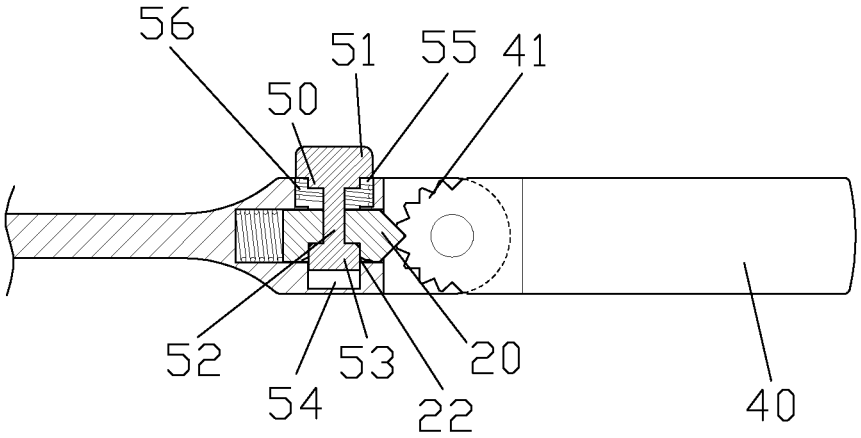
FIG. 10 is a cross sectional view showing the assembly of the angle controlling device for the wrench according to the second embodiment of the present invention.

As shown in FIGS. 8 to 10, a difference of an angle controlling device for a ratchet wrench 10 of a second embodiment from that of the first embodiment comprises: a pressing member 51 inserted into a top end of the connecting head 12, a small-diameter opening 54 extending downwardly from a top surface of the connecting head 12, a large-diameter opening 55 defined above the small-diameter opening 54 and accommodating a third resilient element 56, a circular locking block 53 arranged on a bottom end of the pressing member 50, a small-diameter column 52 defined above the circular locking block 53, a press portion 51 arranged on a top end of the pressing member 50, wherein a width of the press portion 51 is equal to a diameter of the large-diameter opening 55. In addition, a cutout 21 of the retainer 20 extending longitudinally to correspond to the pressing member 50, and an indentation 22 is defined on an inner surface of the retainer 20, such that when the pressing member 50 engages with the retainer 20, the small-diameter column 52 moves in the cutout 21, the circular locking block 53 retains in the indentation 22 of the retainer 20, and the third resilient element 56 pushes the press portion 51 so that the pressing member 50 moves back to an original position, Thereby, when the pressing member 50 is pressed inwardly, the retainer 20 is released; and after the pressing member 50 moves back to the original position, the retainer 20 retains with the toothed portion 41.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An angle adjusting device for a wrench comprising:

an operating handle, a connecting head connecting with a front end of the operating handle, an accommodating cavity defined in a front end of the connecting head, and a driving member coupling with a front end of the connecting head;

the driving member having a toothed portion formed on a rear end thereof and arranged in the accommodating cavity of the connecting head;

the accommodating cavity having two orifices defined on two extending arms of two sides thereof, and the toothed portion of the driving member having an aperture formed therein to correspond to the two orifices, such that a coupling post is inserted into the two orifices and the aperture to connect the connecting head the driving member together;

the accommodating cavity also having a notch arranged in a rear end thereof, and the connecting head having a trough defined on one of the two sides thereof and accommodating a first resilient element and a pressing member;

the notch accommodating a second resilient element and a retainer, the retainer having a cutout extending backwardly from a middle section thereof and having an indentation defined on one side of the cutout;

the pressing member having a small-diameter column extending outwardly from a central position thereof and a circular retaining tab arranged on a rear end of the small-diameter column.

2. The angle adjusting device for the wrench as claimed in claim 1, wherein the trough vertically communicates with the notch.

3. The ratchet wrench with the fixing structure as claimed in claim 1, wherein when the pressing member is in connection with the retainer, the small-diameter column of the pressing member moves in the cutout of the retainer, and the circular retaining tab of the pressing member retains in the indentation of the retainer.

4. The angle adjusting device for the wrench as claimed in claim 1, wherein when the pressing member is pushed inwardly, the circular retaining tab disengages from the indentation, and the second resilient element pushes the retainer so that the retainer abuts against the toothed portion of the driving member, and when the driving member rotates, the retainer rotatably contacts with the toothed portion.

5. An angle adjusting device for a wrench comprising:

an operating handle, a connecting head connecting with a front end of the operating handle, an accommodating cavity defined in a front end of the connecting head, and a driving member coupling with a front end of the connecting head;

the driving member having a toothed portion formed on a rear end thereof and arranged in the accommodating cavity of the connecting head;

the accommodating cavity having two orifices defined on two extending arms of two sides thereof, and the toothed portion of the driving member having an aperture formed therein to correspond to the two orifices, such that a coupling post is inserted into the two orifices and the aperture to connect the connecting head the driving member together;

the accommodating cavity also having a notch arranged in a rear end thereof, and the connecting head having a small-diameter opening extending downwardly from a top surface thereof and accommodating a first resilient element and a pressing member, the connecting head also having a large-diameter opening defined above the small-diameter opening;

the notch accommodating a second resilient element and a retainer, the retainer having a cutout extending backwardly from a middle section thereof and having an indentation defined on one side of the cutout;

the pressing member having a small-diameter column extending outwardly from a central position thereof, a circular retaining tab arranged on a rear end of the small-diameter column, and a press portion arranged on a top end thereof.

6. The angle adjusting device for the wrench as claimed in claim 5, wherein a width of the press portion is equal to a diameter of the large-diameter opening, the large-diameter opening accommodates a third resilient element.

* * * * *